US007073869B2

(12) United States Patent
Nakakuro

(10) Patent No.: US 7,073,869 B2
(45) Date of Patent: Jul. 11, 2006

(54) SHIELD TUNNELING MACHINE

(75) Inventor: Kenichi Nakakuro, Toyama-ken (JP)

(73) Assignees: Nakakuro Construction Co., Ltd., Toyama-ken (JP); Tokyo Metropolitan Sewerage Service Corporation, Tokyo (JP)

( * ) Notice: Subject to any disclaimer, the term of this patent is extended or adjusted under 35 U.S.C. 154(b) by 0 days.

(21) Appl. No.: 10/942,136

(22) Filed: Sep. 16, 2004

(65) Prior Publication Data

US 2005/0077775 A1 Apr. 14, 2005

(30) Foreign Application Priority Data

Sep. 22, 2003 (JP) ..... 2003-329441

(51) Int. Cl.
*E21D 9/10* (2006.01)
*E21C 25/60* (2006.01)

(52) U.S. Cl. ..... 299/81.3; 299/81.2; 299/55; 299/17

(58) Field of Classification Search ..... 299/1.05, 299/1.4, 1.6, 1.8, 16, 17, 55–61, 81.1–81.3
See application file for complete search history.

(56) References Cited

U.S. PATENT DOCUMENTS

| | | | | | |
|---|---|---|---|---|---|
| 3,475,055 | A | * | 10/1969 | Snedden | 299/14 |
| 3,784,103 | A | * | 1/1974 | Cooley | 239/101 |
| 4,534,427 | A | * | 8/1985 | Wang et al. | 175/67 |
| 4,624,326 | A | | 11/1986 | Loegel, Jr. | |

FOREIGN PATENT DOCUMENTS

| | | |
|---|---|---|
| JP | 10-331589 | 12/1998 |
| JP | 11-81861 | 3/1999 |
| JP | 2002-81289 | 3/2002 |
| JP | 2002-332795 | 11/2002 |

* cited by examiner

*Primary Examiner*—Sunil Singh
(74) *Attorney, Agent, or Firm*—Wenderoth, Lind & Ponack, L.L.P.

(57) ABSTRACT

A shield tunneling machine has a shield body and a cutter head rotatably provided at the forward end of the shield body in the excavation direction. Abrasive jet spray nozzles for spraying abrasive jet water are movably provided on the cutter head. Obstacles encountered during excavation can be broken efficiently with high cutting quality by properly controlling the movable abrasive jet spray nozzles according to the size and configuration of each particular obstacle.

11 Claims, 10 Drawing Sheets

SHIELD TUNNELING MACHINE

BACKGROUND OF THE INVENTION

The present invention relates to a shield tunneling machine that excavates a tunnel or other similar passage while crushing obstacles encountered during excavation.

There has heretofore been known a shield tunneling machine having water jet spray nozzles provided on a cutter head that is provided at the forward end of a shield body in the excavation direction and is rotatable relative to the shield body to excavate a tunnel or the like while crushing obstacles encountered during excavation [see Japanese Patent Application Unexamined Publication (KOKAI) No. Hei 10-280880].

However, the conventional shield tunneling machine still has a problem to be solved. That is, because the spray nozzles are immovable, it is impossible to properly control the spray nozzles according to the size and configuration of each particular obstacle encountered during excavation, and hence it is difficult to break it into easily removable pieces with high cutting quality.

SUMMARY OF THE INVENTION

In view of the above-described circumstances, an object of the present invention is to provide a shield tunneling machine that is capable of breaking obstacles effectively with high cutting quality by properly controlling movable abrasive jet spray nozzles according to the size and configuration of each particular obstacle.

To attain the above-described object, the present invention provides a shield tunneling machine including a shield body and a cutter head provided at the forward end of the shield body in the excavation direction. The cutter head is rotatable relative to the shield body. An abrasive jet spray nozzle for spraying abrasive jet water is movably provided on the cutter head.

Preferably, the abrasive jet spray nozzle is radially movable and thus capable of cutting an obstacle encountered during excavation into a round shape and further cutting it radially.

Preferably, the abrasive jet spray nozzle is oscillatable to allow the spray direction to be changed.

Preferably, a slurry is mixed in the abrasive jet water sprayed from the abrasive jet spray nozzle.

Preferably, a fixed spray nozzle for spraying high-pressure jet water is provided on the cutter head, and the obstacle is searched for on the basis of reflected sound of high-pressure jet water sprayed from the fixed spray nozzle.

The fixed spray nozzle may be used for cleaning cutter bits provided on the cutter head.

Preferably, cutter bits are provided in proximity to the abrasive jet spray nozzle to protect it.

Preferably, a drive mechanism for the abrasive jet spray nozzle is a hydraulic cylinder drive system comprising a cylinder and a piston rod.

The drive mechanism for the abrasive jet spray nozzle may be a threaded rod drive system comprising a drive motor and a threaded rod.

The drive mechanism for the abrasive jet spray nozzle may be a rack-and-pinion drive system comprising a drive motor, a rack and a pinion.

Preferably, at least two radially spaced abrasive jet spray nozzles are provided as the above-described abrasive jet spray nozzle. Each abrasive jet spray nozzle is supported by a nozzle head and is radially movable.

Preferably, the nozzle head is provided in a radially extending enclosure. The enclosure is always supplied with cleaning water. The nozzle head is immersed in the cleaning water and is radially movable.

Preferably, each abrasive jet spray nozzle is swivelable.

Preferably, the swivelable abrasive jet spray nozzle is decentered with respect to the swivel axis.

In the shield tunneling machine according to the present invention, the abrasive jet spray nozzles are movable relative to the cutter head. Therefore, obstacles encountered during excavation can be broken effectively with high cutting quality by properly controlling the movable abrasive jet spray nozzles according to the configuration and size of each particular obstacle.

Thus, according to the present invention, abrasive jet spray nozzles are provided on the cutter head. While the cutter head is being rotated, abrasive jet water is sprayed from the nozzles to cut an obstacle into ring shapes. Then, while the abrasive jet spray nozzles are being moved radially, abrasive jet water is sprayed therefrom, thereby breaking a large obstacle into fan-shaped pieces.

The above and other objects, features and advantages of the present invention will become more apparent from the following description of the preferred embodiments thereof, taken in conjunction with the accompanying drawings.

DETAILED DESCRIPTION OF THE INVENTION

Embodiments of the shield tunneling machine according to the present invention will be described below in detail with reference to the accompanying drawings.

Figure 1:
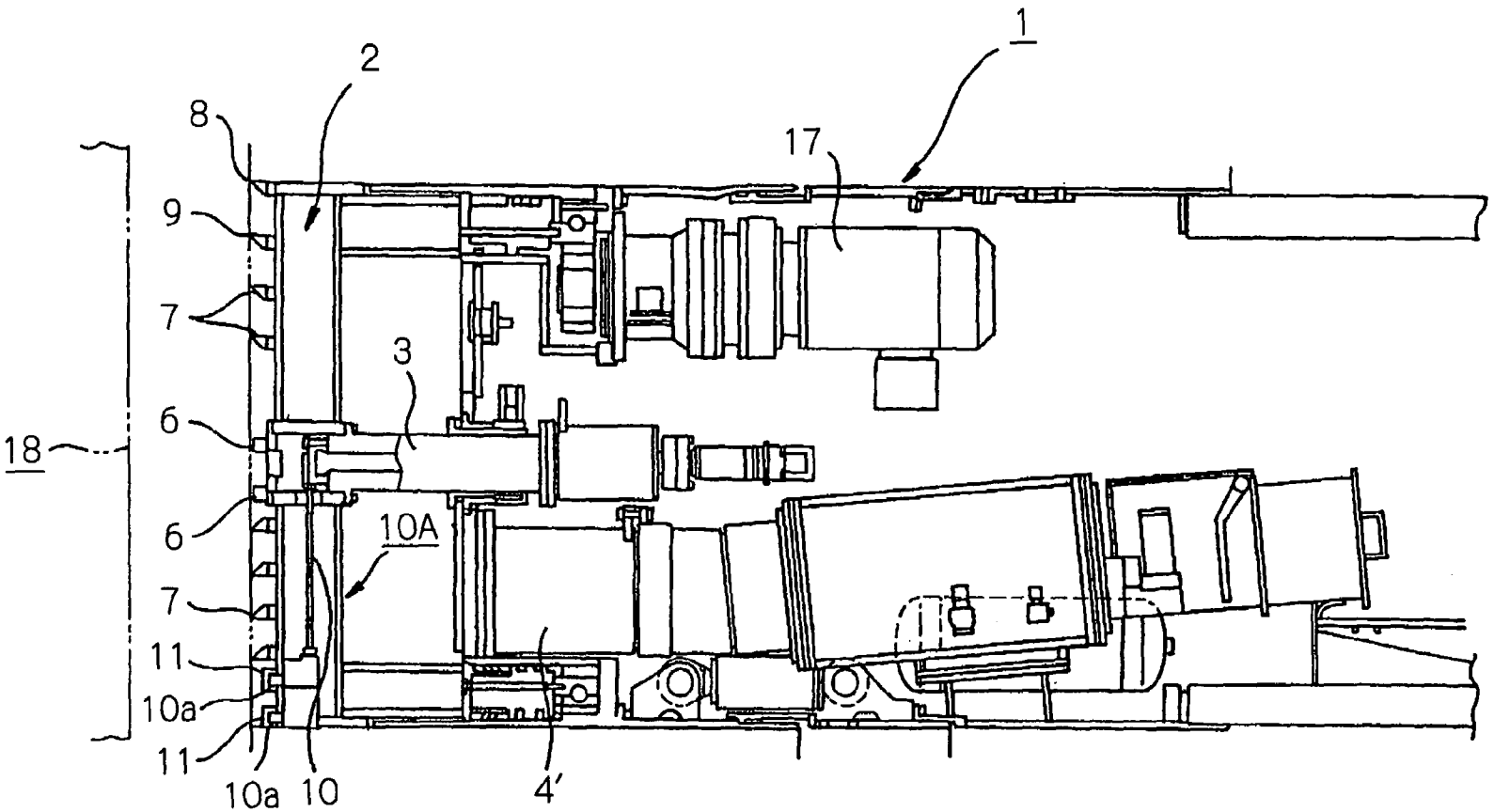
FIG. 1 is a fragmentary longitudinal sectional view of the shield tunneling machine according to an embodiment of the present invention, showing a shield body including a cutter head.
Figure 2:
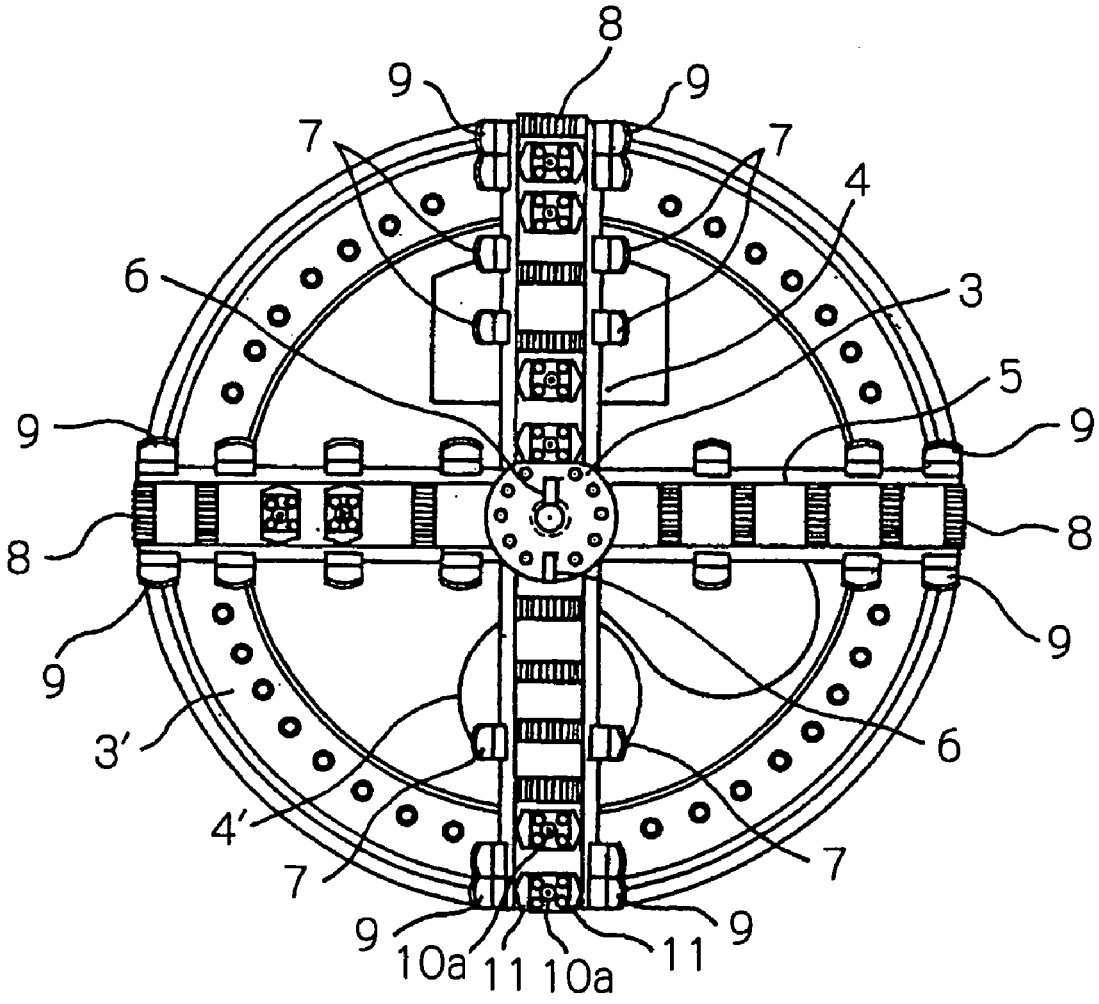
FIG. 2 is a front view of the cutter head shown in FIG. 1.

FIG. 1 is a fragmentary longitudinal sectional view of the shield tunneling machine according to an embodiment of the present invention, showing a shield body 1 of the shield tunneling machine. In FIG. 1, the shield body 1 includes a cutter head 2 having a rotating shaft 3. The shield body 1 further includes a slurry discharge pipe 4'. The cutter head 2 is provided at the forward end of the shield body 1 in the excavation direction. As shown in FIG. 2, the cutter head 2 has a ring plate 3'. The ring plate 3' has mounting plates 4 and 5 secured thereto. The mounting plates 4 and 5 extend diametrically of the ring plate 3' and intersect each other perpendicularly.

The mounting plates 4 and 5 intersect each other at the rotating shaft 3. The mounting plates 4 and 5 are provided with center bits 6, cutter bits 7, leading bits 8 and trimming bits 9 appropriately.

In this embodiment, the mounting plate 4 is provided with nozzle heads 10 on both lateral sides thereof. Each nozzle head 10 has abrasive jet spray nozzles 10*a*. Cutter bits 11 are provided at both sides of each abrasive jet spray nozzle 10*a* to protect it.

Figure 3:
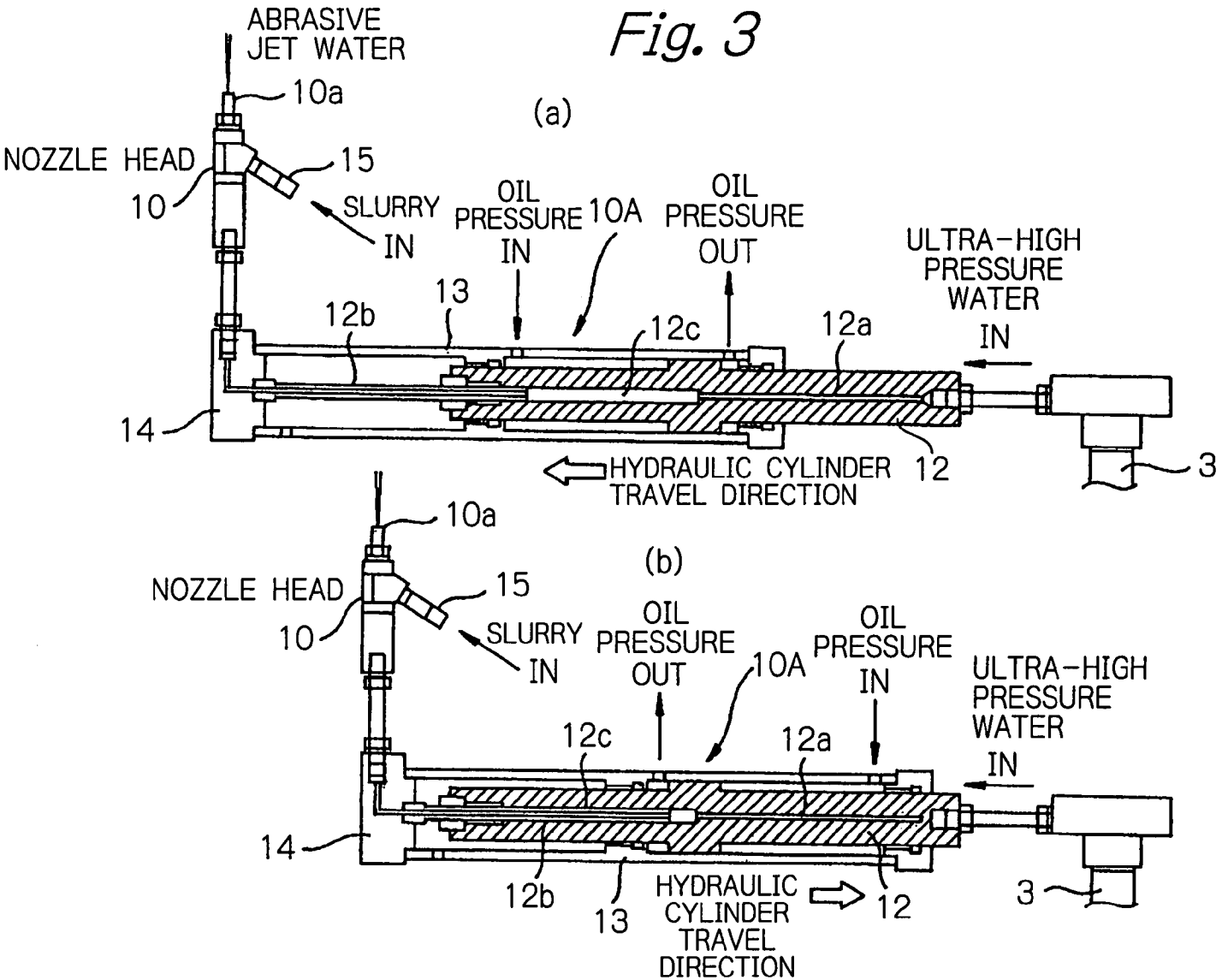
FIG. 3 is a diagram showing a hydraulic cylinder drive mechanism for abrasive jet spray nozzles shown in FIG. 2, in which (a) shows a state where a nozzle head is positioned radially outward, and (b) shows a state where the nozzle head is positioned radially inward.

The nozzle head 10 is driven by a drive mechanism (drive system) 10A as shown in parts (a) and (b) of FIG. 3. In this embodiment, the drive mechanism 10A is a hydraulic cylinder drive system comprising a piston rod 12 and a hydraulic cylinder 13. The nozzle head 10 is secured to one end of the cylinder 13 through a mounting head 14. The cylinder 13 is movable in reciprocating directions along the piston rod 12 in response to switching between IN and OUT of oil pressure.

The piston rod 12 is formed with a passage 12*a* for supplying ultra-high pressure water from the rotating shaft 3. The passage 12*a* communicates with the abrasive jet spray nozzles 10*a* through a supply pipe 12*b*.

Figure 4:
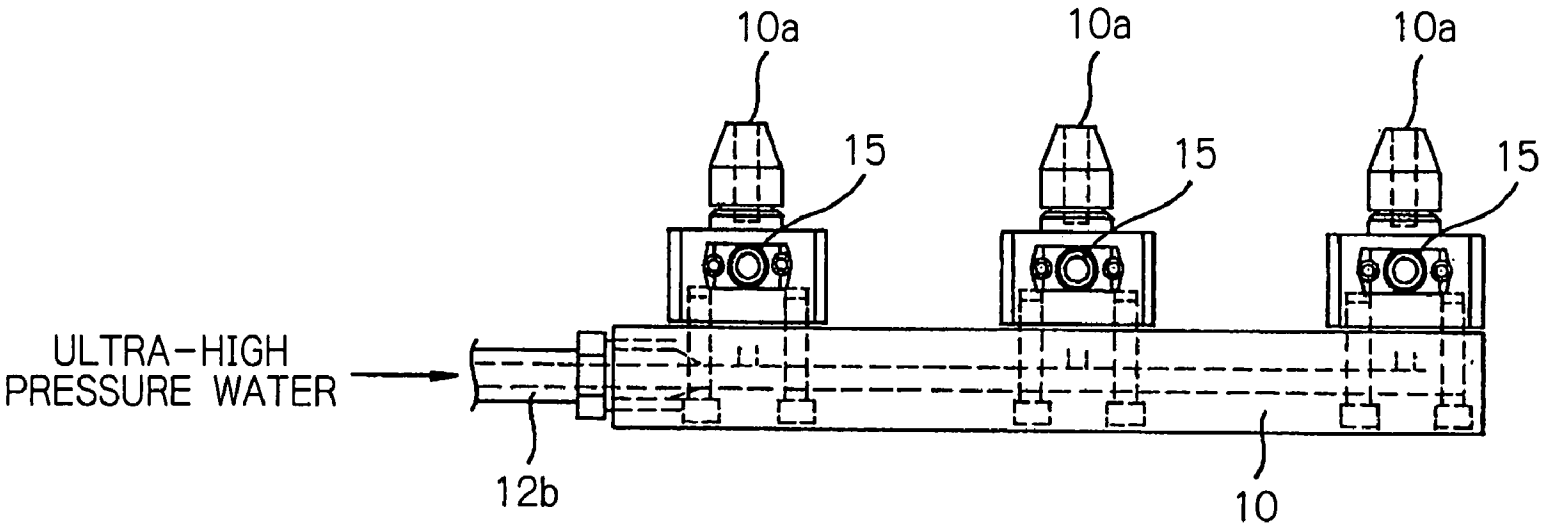
FIG. 4 is a diagram showing in detail the arrangement of the nozzle head shown in FIG. 2.
Figure 5:
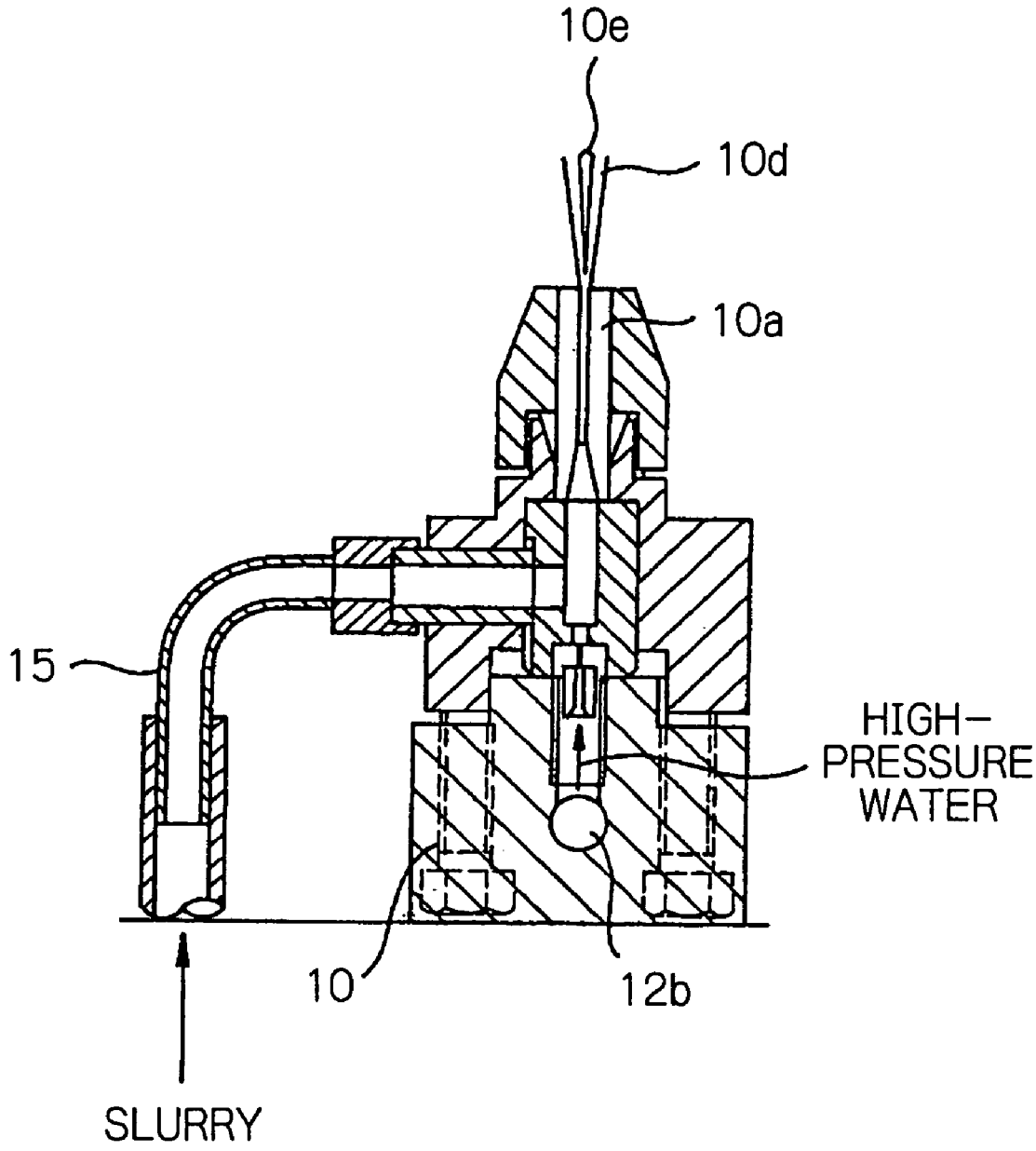
FIG. 5 is a diagram showing in detail the arrangement of the abrasive jet spray nozzle shown in FIG. 4.
Figure 6:
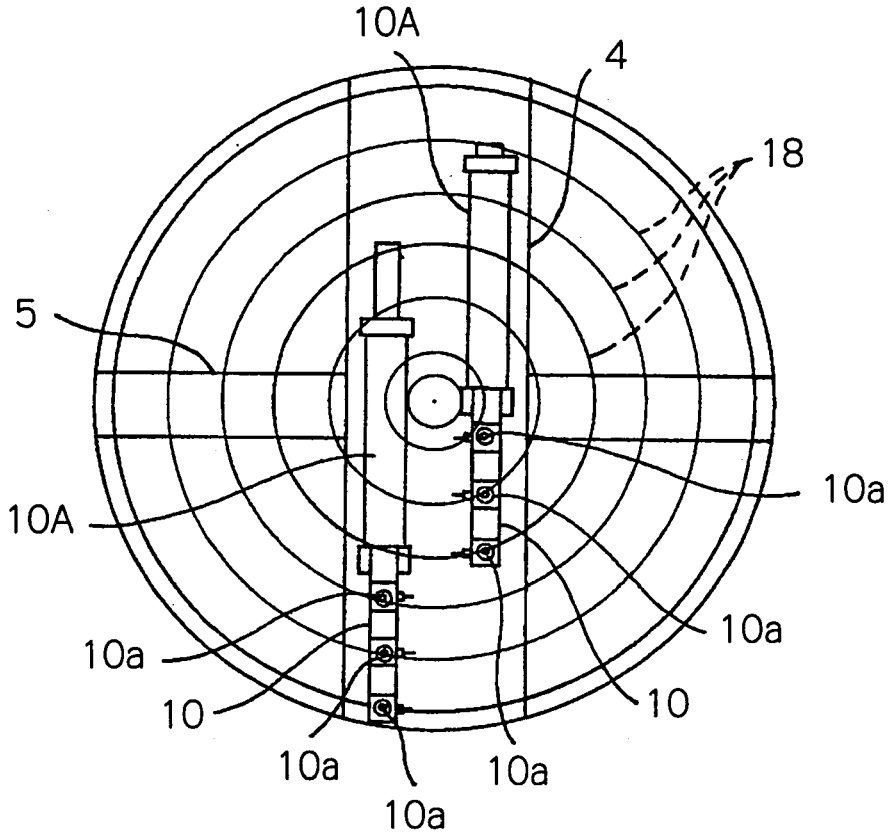
FIG. 6 is a schematic view for explaining the operation of the abrasive jet spray nozzles shown in FIG. 2.

The piston rod 12 has a space 12*c* for allowing the supply pipe 12*b* to advance and retract in the piston rod 12. FIGS. 4 and 5 show the arrangement of the nozzle head 10 in detail. The nozzle head 10 is connected with supply pipes 15 for supplying a slurry (starch-based cutting fluid). As shown in FIG. 5, abrasive jet water 10*e* is sprayed with air 10*d* surrounding it. In this embodiment, three abrasive jet spray nozzles 10*a* are provided for each nozzle head 10, as shown schematically in FIG. 6. The abrasive jet spray nozzles 10*a* are spaced in the radial direction of the cutter head 2, in which the mounting plate 4 extends. It should be noted, however, that one or two abrasive jet spray nozzles 10*a* may be provided for each nozzle head 10.

As shown in FIG. 1, the cutter head 2 is rotated about the rotating shaft 3 by a drive motor 17. While the cutter head 2 is rotating, abrasive jet water 10*e* is sprayed from the abrasive jet spray nozzles 10*a*, thereby allowing an obstacle 18 encountered during excavation to be cut in ring shapes. Further, by moving the abrasive jet spray nozzles 10*a* radially at high speed, the obstacle 18 cut in ring shapes can be cut radially.

With the abrasive jet spray nozzles 10*a*, because a slurry is mixed into high-pressure jet water, it is possible to cut and break the obstacle 18 efficiently while minimizing the wear of the abrasive jet spray nozzles 10*a*.

The drive mechanism 10A for the abrasive jet spray nozzles 10*a* according to the present invention is not limited to that shown in FIG. 3. The drive mechanism 10A may be arranged as shown in the following modifications.

(First Modification)

Figure 7:
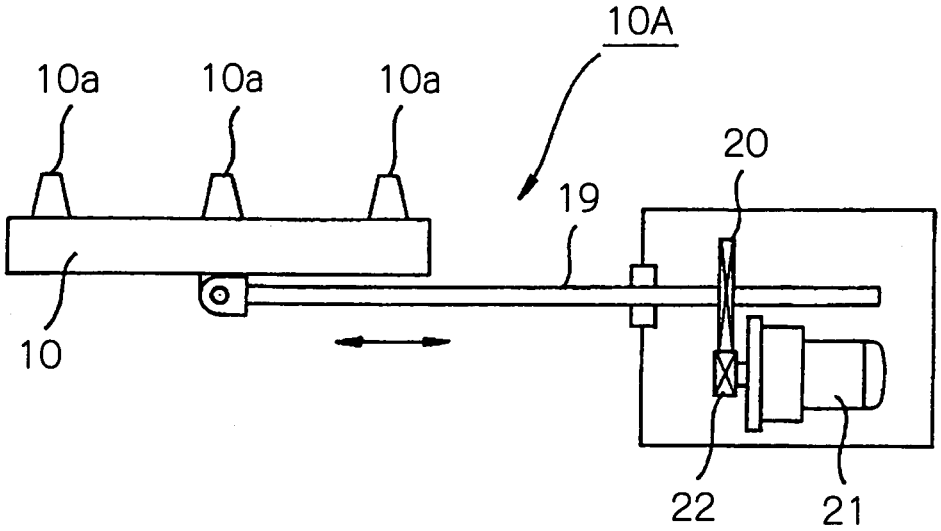
FIG. 7 is a diagram showing a threaded rod drive mechanism as another example of the abrasive jet spray nozzle drive mechanism shown in FIG. 2.

For example, as shown in FIG. 7, the nozzle head 10 is secured to the forward end of a threaded rod 19, and a gear 20 is provided on the rear end of the threaded rod 19. An output shaft 22 of a drive motor 21 is meshed with the gear 20. With this drive mechanism, the rotation of the drive motor 21 is converted into forward or backward movement of the threaded rod 19, thereby moving the nozzle head 10 back and forth in the radial direction.

(Second Modification)

Figure 8:
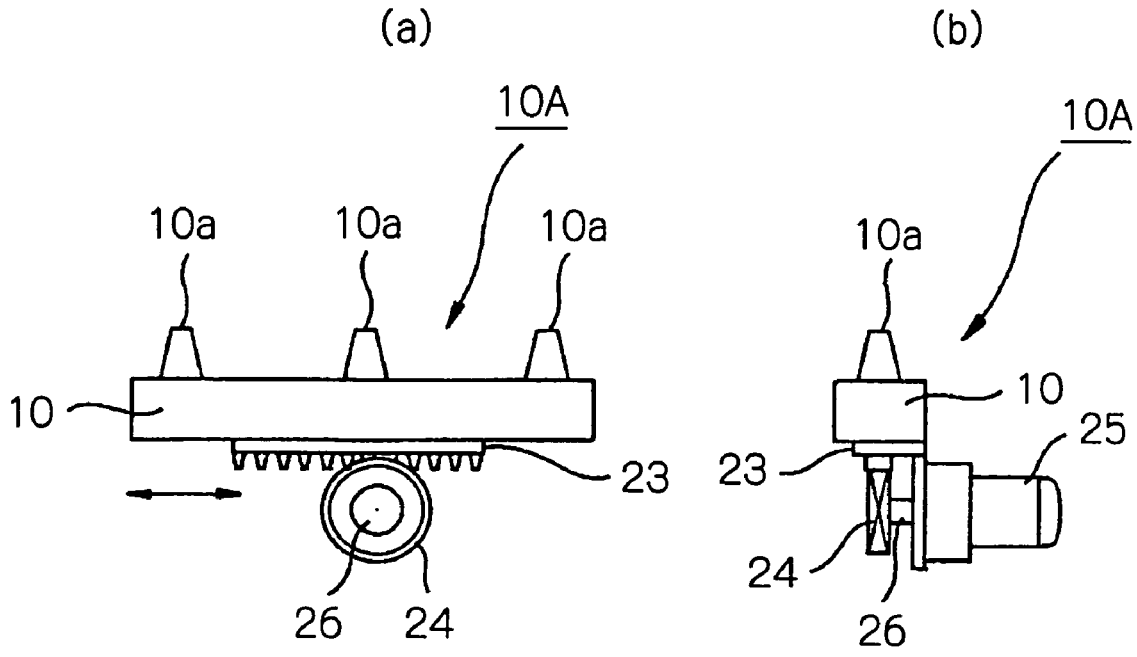
FIG. 8(*a*) is a diagram showing a rack-and-pinion drive mechanism as another example of the abrasive jet spray nozzle drive mechanism shown in FIG. 2, FIG. 8(*b*) is an end view of the drive mechanism shown in FIG. 8(*a*).

For example, as shown in parts (a) and (b) of FIG. 8, the nozzle head 10 is provided with a rack 23, and a pinion 24 that is meshed with the rack 23 is mounted on an output shaft 26 of a drive motor 25. With this drive mechanism, the rotation of the drive motor 25 is converted into forward or backward movement of the rack 23, thereby moving the nozzle head 10 back and forth in the radial direction.

(Third Modification)

Figure 9:
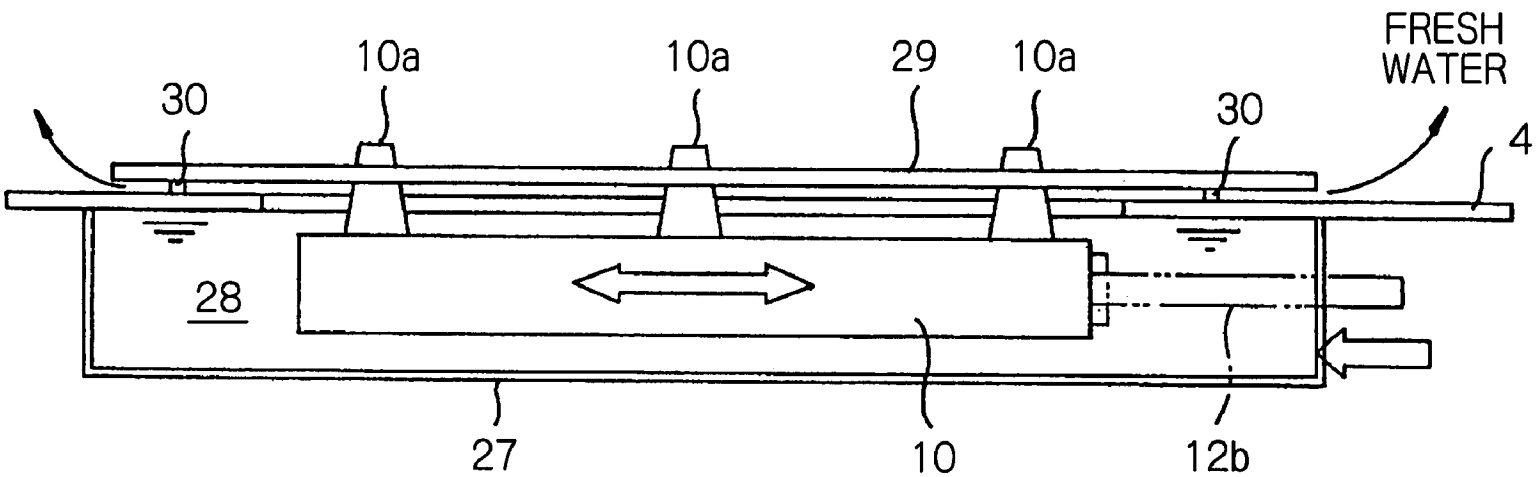
FIG. 9 is an explanatory view showing an arrangement in which the nozzle head shown in FIG. 2 is reciprocatably immersed in cleaning water.

It is desirable from the viewpoint of protecting the drive mechanism 10A from sludge and other contamination that the nozzle head 10 according to the present invention should be arranged as shown in FIG. 9. That is, a radially extending vessel 27 is provided on the mounting plate 4, and cleaning water 28 is always supplied into the vessel 27. The inside of the vessel 27 is held at a positive pressure, and the nozzle head 10 is immersed in the cleaning water 28.

With the above-described arrangement, it is possible to prevent adhesion of contamination to the drive mechanism 10A. Hence, it is possible to allow the nozzle head 10 to reciprocate smoothly and to minimize the incidence of failure. It should be noted that in FIG. 9 reference numeral 29 denotes a nozzle cover, and reference numeral 30 denotes seal rings.

(Fourth Modification)

Figure 10:
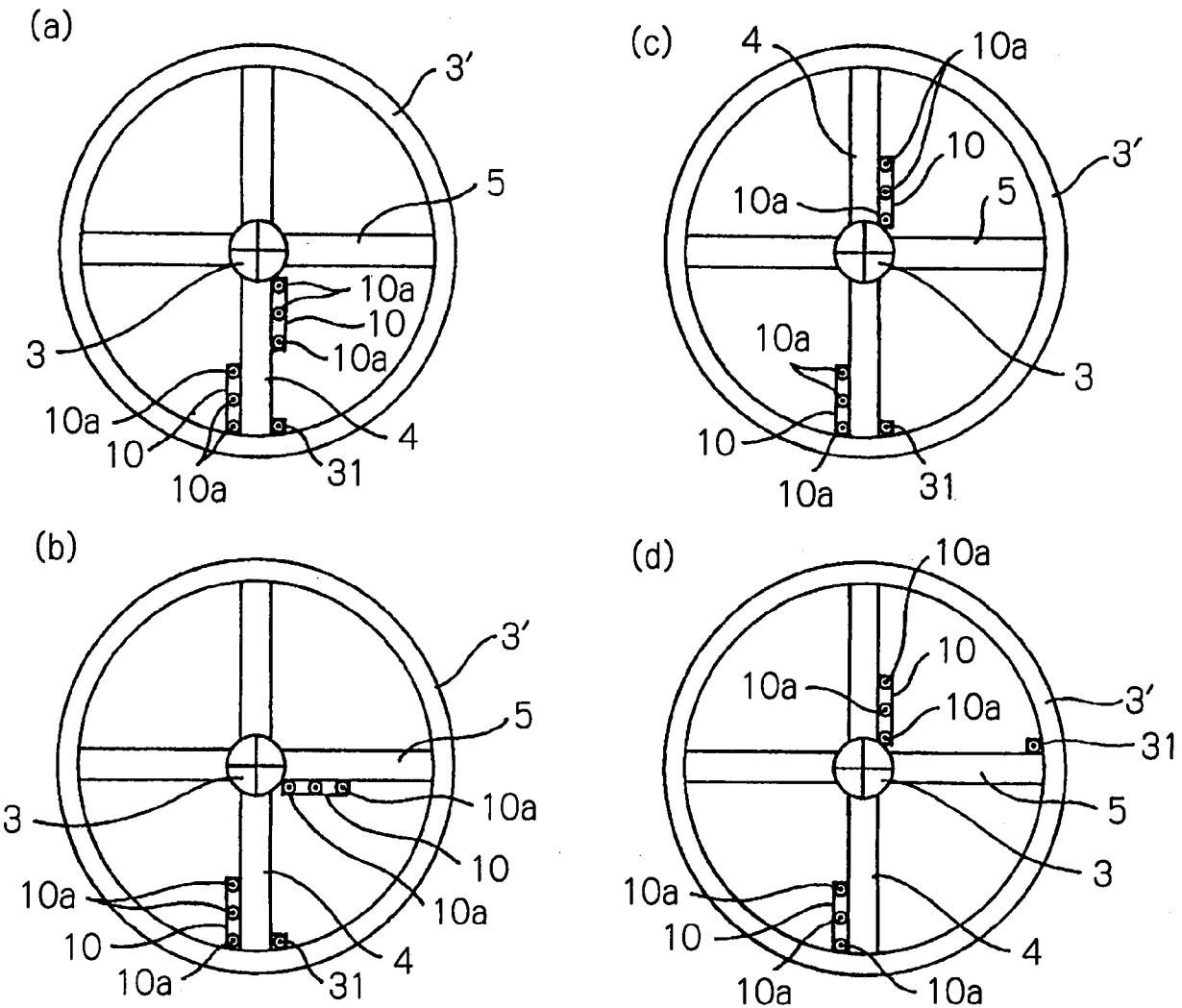
FIG. 10 is a schematic view showing various examples of the layout of nozzle heads shown in FIG. 2, in which: (a) shows an arrangement in which nozzle heads are provided on both sides, respectively, of one mounting plate, and a fixed spray nozzle is provided on this mounting plate; (b) shows an arrangement in which one nozzle head is installed on one mounting plate, and the other nozzle head is installed on the other mounting plate, and moreover, a fixed spray nozzle is provided on the first-mentioned mounting plate; (c) shows an arrangement in which nozzle heads are provided on one mounting plate at respective positions opposite each other across the rotating shaft, and a fixed spray nozzle is installed on this mounting plate; and (d) shows an arrangement in which nozzle heads are provided on one mounting plate at respective positions opposite each other across the rotating shaft, and a fixed spray nozzle is installed on the other mounting plate.

In the foregoing embodiment, the nozzle heads are provided on both lateral sides of the mounting plate 4 as shown schematically in (a) of FIG. 10. However, the present invention is not necessarily limited to the above. The arrangement may be such that, as shown schematically in (b) of FIG. 10, one nozzle head 10 is installed on the mounting plate 4, and the other nozzle head 10 is installed on the mounting plate 5, which extends in a direction perpendicular to the mounting plate 4. The arrangement may also be such that, as shown schematically in (c) and (d) of FIG. 10, the nozzle heads 10 are provided at respective positions opposite each other across the rotating shaft 3.

Further, the arrangement may be such that, as shown in (a) to (c) of FIG. 10, a fixed spray nozzle 31 that sprays high-pressure jet water is provided on the mounting plate 4. Sound generated by spraying of high-pressure jet water from the fixed spray nozzle 31 and reflected from the obstacle 18 is analyzed with an oscilloscope. In this way, the presence of the obstacle 18 is searched for, and the nozzle heads 10 are moved based on the result of the analysis.

The fixed spray nozzle 31 may be provided on the mounting plate 5, which intersects the mounting plate 4 perpendicularly, as shown in (d) of FIG. 10.

Although in this embodiment the fixed spray nozzle 31 is used to search for an obstacle 18, it may be used for cleaning the cutter bits 7.

(Fifth Modification)

Figure 11:
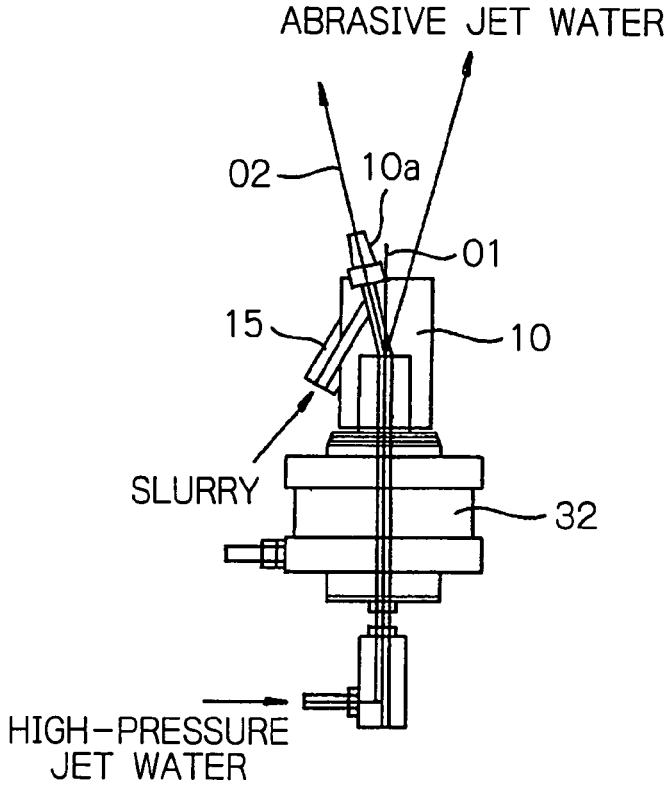
FIG. 11 is a conceptual view showing an example in which the abrasive jet spray nozzle is provided swivelably.
Figure 12:
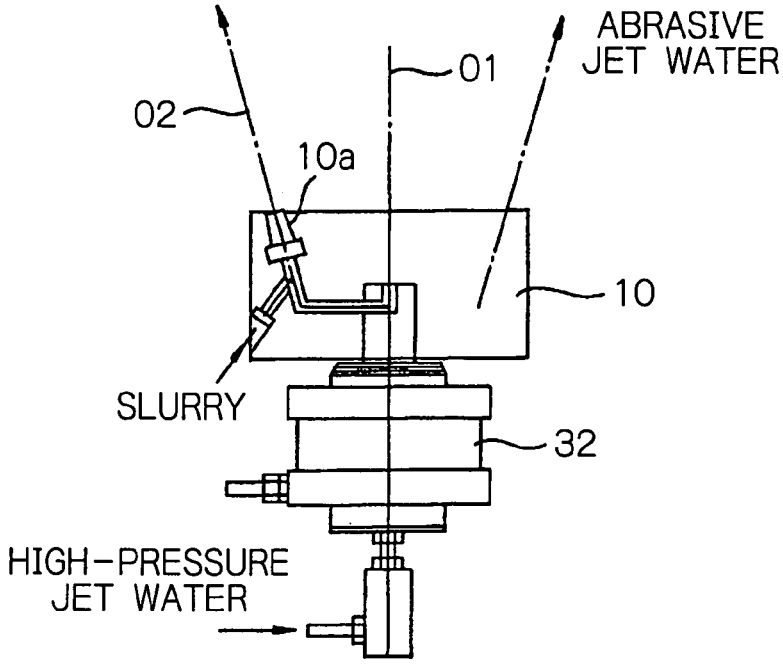
FIG. 12 is a conceptual view showing another example in which the abrasive jet spray nozzle is provided swivelably and decentered with respect to the swivel axis.

Although in the foregoing embodiment the nozzle heads 10 are radially movable, the arrangement may be as follows. As shown in FIG. 11, the nozzle head 10 is mounted on a hydraulic rotary actuator 32. The spray direction 02 of the abrasive jet spray nozzle 10*a* is set obliquely to the swivel axis O1 of the nozzle head 10. Thus, the spray direction O2 is changed by swiveling the nozzle head 10. The arrangement may be as shown in FIG. 12. The abrasive jet spray nozzle 10*a* is provided swivelably and decentered with respect to the swivel axis O1 to broaden the range of changes in the spray direction O2 of abrasive jet water.

The shield tunneling machine according to the present invention is usable in construction work of tunnels, underground passages, trenches for piping of water supply and sewerage systems, manholes, and so forth.

It should be noted that the present invention is not limited to the foregoing embodiments but can be modified in a variety of ways.

What is claimed is:

1. A shield tunneling machine comprising:

a shield body; and a cutter head provided at a forward end of said shield body in an excavation direction, said cutter head being rotatable relative to said shield body, said cutter head comprising an enclosure that extends in a radial direction of said cutter head, a nozzle head disposed in said enclosure, at least two radially spaced abrasive jet spray nozzles supported by said nozzle head for spraying abrasive jet water, wherein said nozzle head is radially movable, and said enclosure is always supplied with cleaning water during operation of said cutter head so that said nozzle head is immersed in the cleaning water.

2. A shield tunneling machine according to claim 1, wherein each of said abrasive jet spray nozzles is oscillatable to allow a spray direction to be changed.

3. A shield tunneling machine according to claim 1, further comprising a slurry supply pipe connected to said nozzle head so that a slurry can be mixed in the abrasive jet water sprayed from said abrasive jet spray nozzles.

4. A shield tunneling machine according to claim 1, wherein said cutter head further comprising a fixed spray nozzle, provided on said cutter head, for spraying high-pressure jet water, wherein an obstacle can be searched for on the basis of reflected sound of high-pressure jet water sprayed from said fixed spray nozzle.

5. A shield tunneling machine according to claim 1, wherein said cutter head includes a plurality of cutter bits and a fixed spray nozzle for spraying high-pressure jet water, said fixed spray nozzle being used for cleaning said cutter bits.

6. A shield tunneling machine according to claim 1, wherein said cutter head comprises a plurality of cutter bits disposed in proximity to said abrasive jet spray nozzles.

7. A shield tunneling machine according to claim 1, further comprising a drive mechanism for moving said nozzle head and said abrasive jet spray nozzles, wherein said drive mechanism is a hydraulic cylinder drive system comprising a cylinder and a piston rod.

8. A shield tunneling machine according to claim 1, further comprising a drive mechanism for driving said nozzle head and said abrasive jet spray nozzles, wherein said drive mechanism is a threaded rod drive system comprising a drive motor and a threaded rod.

9. A shield tunneling machine according to claim 1, further comprising a drive mechanism for driving said nozzle head and said abrasive jet spray nozzles, wherein said drive mechanism is a rack-and-pinion drive system comprising a drive motor, a rack and a pinion.

10. A shield tunneling machine according to claim 1, wherein each of said abrasive jet spray nozzles is swivelable.

11. A shield tunneling machine according to claim 10, wherein said abrasive jet spray nozzle is decentered with respect to a swivel axis.

* * * * *